United States Patent [19]

Devellano

[11] 4,078,802

[45] Mar. 14, 1978

[54] CHANCE DISCHARGE GAME APPARATUS

[76] Inventor: Michael Devellano, 2185 Lawrence Ave. E., Scarborough, Ontario, Canada

[21] Appl. No.: 756,827

[22] Filed: Jan. 5, 1977

[51] Int. Cl.[2] ..... A63F 7/02; A63H 33/34

[52] U.S. Cl. ..... 273/138 R; 46/43; 46/124; 273/120 R

[58] Field of Search ..... 273/138 R, 138 A, 139, 273/120 R, 120 A, 86 C, 1 R, 144 A, 145 B; 46/43, 115, 116, 124, 123, 141

[56] References Cited

U.S. PATENT DOCUMENTS

| | | | |
|---|---|---|---|
| 613,414 | 11/1898 | Harrison et al. | 273/138 R |
| 814,463 | 3/1906 | Linderman et al. | 273/138 R |
| 868,632 | 10/1907 | Almstrom et al. | 46/124 X |
| 1,167,655 | 1/1916 | Passig | 273/120 R |
| 1,363,570 | 12/1920 | Cotter | 273/144 A X |
| 1,594,847 | 8/1926 | Otto | 46/124 X |
| 2,256,340 | 9/1941 | Gora et al. | 46/124 |
| 2,408,687 | 10/1946 | Sanchez | 273/138 R |
| 2,705,090 | 3/1955 | Odermatt-Wehrli | 46/123 X |
| 2,873,119 | 2/1959 | O'Rourke | 273/138 R |
| 3,190,656 | 6/1965 | Weisbecker | 273/138 R |
| 3,383,792 | 5/1968 | Goldfarb | 273/144 A X |
| 3,442,512 | 5/1969 | Glass et al. | 46/120 X |

*Primary Examiner*—Richard C. Pinkham

*Assistant Examiner*—Arnold W. Kramer

[57] ABSTRACT

Game apparatus includes a three dimensional representation of a duck in which there is a pellet receiving opening in the mouth and pellet discharge opening in the lower rear of the duck. A cavity is formed internally of the duck and a plate is mounted horizontally within the cavity above the discharge opening. A hollow tube connects the pellet receiving opening with the cavity above the plate. A plurality of apertures are formed in the plate at the opposed sides thereof and extend through the plate from top to bottom. A hollow tube element depends from the plate connected in each of the plate apertures. Each such tube element has an aperture in at least the side wall closest to the adjacent internal surface of the duck. Openings are formed in the opposed sides of the duck corresponding to and aligned with the apertures in the tube elements. Pull pins are slidably mounted in the openings in the sides of the duck and the inner end of each such pull pin is dimensioned to slide within the corresponding tube element aperture. A selector element such as a spinner device is provided having colored sectors and the sectors of the spinner device and the pull pins are color coded. The game apparatus includes at least one pellet dimensioned to pass sequentially through the pellet receiving opening, a plate aperture tube element and through the discharge opening.

7 Claims, 5 Drawing Figures

FIG.1
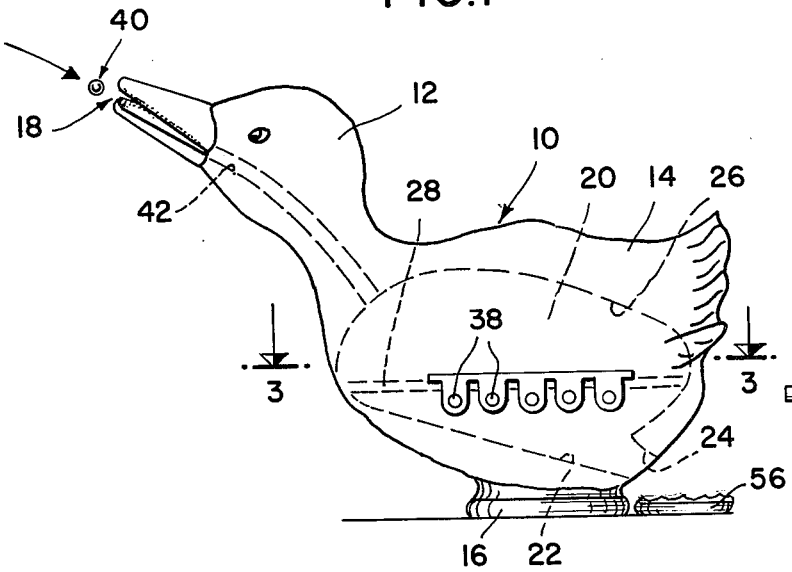
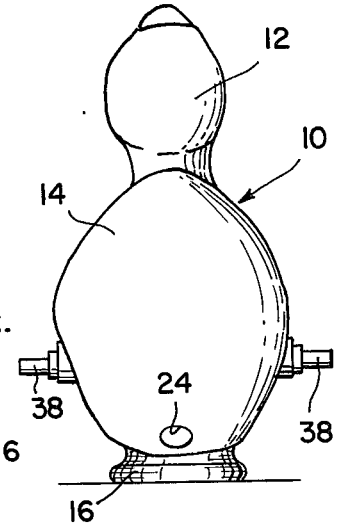
FIG.2
FIG.3
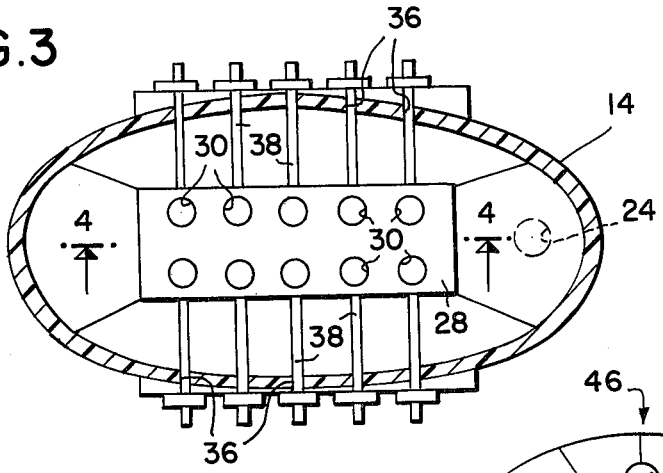
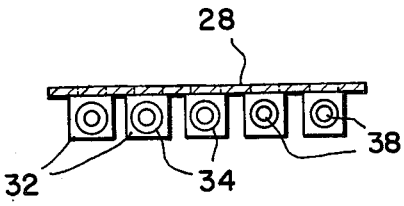
FIG.4
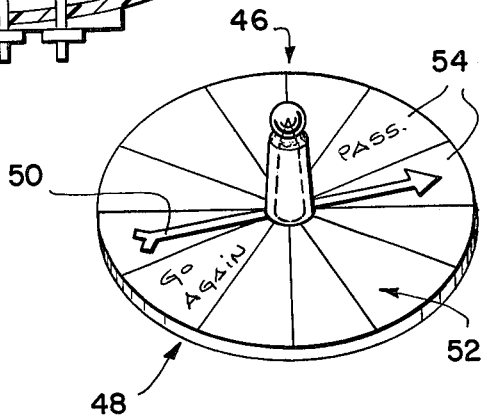
FIG.5

CHANCE DISCHARGE GAME APPARATUS

BACKGROUND OF THE INVENTION

The present invention relates to game apparatus in which a three dimensional animal representation is constructed to dispense pellets through manipulation of pull pins which are determined by chance.

Toys which are constructed to discharge pellets upon impact by a projectile have been employed heretofore as target devices. U.S. Pat. No. 1,390,789 issued Sept. 13, 1921 to St. Charles Jacobs and U.S. Pat. No. 2,971,761 issued Feb. 14, 1961 to C. O. Musser are representative of such toys. The Jacobs toy requires that the animal representation be struck with sufficient force to cause tilting of the animal body to discharge the pellet whereas the Musser toy provides a complex arrangement of chutes and lever elements and also requires that the target element be struck with a projectile.

There has thus been no game apparatus available heretofore to applicant's knowledge which includes an animal representation adapted to dispense pellets in response to pull pin elements which are selected by manipulation of a selector device operable on the principle of chance. Such a game, particularly where the animal is a duck, goose or hen and the pellet is a golden egg, would be most entertaining for children.

SUMMARY OF THE INVENTION

It is one object of the invention to provide game apparatus consisting essentially of a three dimensional pellet dispensing animal representation and a selector device whereby each player is guided by chance to the manipulation of one of a series of pellet discharge control pins and an unknown one of such control pins is actually operable to effect the discharge of the pellet.

It is another object of the invention to provide game apparatus in the form of an egg-dispensing toy duck which relies wholly on the element of chance in the selection of the proper control means for the dispensing of an egg.

Other objects and advantages of the invention will become readily apparent from the following description of the invention.

According to the present invention there is provided a three dimensional animal representation including head and body sections and adapted to be self-supporting in an upright position;

- a pellet receiving opening in said head section;
- a cavity within said body section;
- a plate member mounted horizontally within said cavity and having a plurality of apertures extending therethrough;
- a downwardly inclined passageway in said head section communicating at the upper end thereof with said pellet receiving opening and at the lower end thereof with said cavity at a location above said plate;
- a plurality of hollow tube elements each depending from a respective one of said plate apertures and having an aperture in at least the side wall thereof closest the adjacent internal surface of said body section;
- a plurality of openings in the opposed side walls of said body section, each of said body section side wall openings being in alignment with the aperture in one of said tube elements;

- a pull pin slidably mounted in each of said body section side wall openings and dimensioned to slide within the corresponding aligned tube element aperture, each of said pull pins having indicia adapted to visually distinguish same from the other of said pull pins;
- a discharge opening in said body section adapted to receive the pellets descending from said tube elements and to discharge same from said body section;
- at least one pellet dimensioned to pass sequentially through said pellet receiving opening, passageway, plate aperture, tube element and discharge opening;
- and a selector element having indicia thereon representative of each of said pull pins.

BRIEF DESCRIPTION OF THE DRAWINGS

In order that the invention may be more fully comprehended it will now be described, by way of example, with reference to the accompanying drawings in which;

FIG. 1 is a side elevational view of the game apparatus of the invention in the form of a pellet dispensing duck;

FIG. 2 is a rear view of the duck shown in FIG. 1;

FIG. 3 is a top plan view, partly in cross section of the duck shown in FIG. 1 taken along section line 3—3 thereof;

FIG. 4 is a side elevational view, partly in cross-section, of the plate and its depending tube elements shown in FIG. 3 and taken along line 4—4 thereof and;

FIG. 5 is a perspective view of a spinner device

DETAILED DESCRIPTION OF THE INVENTION

Referring to the drawings there is shown a three dimensional animal representation 10 in the preferred form of a duck. The duck may be constructed of any suitable material and includes head and body sections 12, 14. The duck should be capable of sitting in an upright position as depicted in FIG. 1. This may require the provision of a base section 16.

The duck is given a pellet receiving opening 18 in the head section and desirably such opening constitutes the mouth of the animal.

Within the body section 14 there is formed a cavity 20. The bottom wall 22 of the cavity preferably is included downwardly towards the rear of the animal at which location there is provided a pellet discharge opening 24. In a preferred form of the invention the bottom wall 22 and the upper wall 26 of the cavity converge to define the discharge opening 24.

There is horizontally mounted within the cavity, such as by chips (not shown), or by any suitable means, a plate member 28. The plate member, as shown most clearly in FIG. 3, may take the shape of the cavity and, therefore, may be generally elliptical as may be the shape of the cavity at the elevation at which the plate member is mounted thereon. However, the configuration of the cavity, and likewise the shape of the plate member, is not critical. A plurality of apertures 30 are formed in the plate so as to extend therethrough. Desirably the apertures are arranged along the opposed sides of the plate and are spaced from each other, there being preferably an equal number of apertures on each side. A total of ten such apertures has been found appropriate in creating a desirable external visual appearance for the duck and in affording a sufficient number of pull pins so as to generate interest in the game. It will become clear as this description ensues that the number of apertures in the plate determines the number of pull pins which are located externally of the body section.

A plurality of hollow tube elements 32 depend from the plate member, each of such tube elements being connected to the plate so as to constitute a continuation of the plate aperture. Such tube elements may be flexible hose members or rigid tubes. The tube elements may, if desired, be formed integrally with the plate member. Each tube element is given an aperture 34 in at least the side wall thereof which is closest to the adjacent internal surface of the cavity. If desired a pair of such apertures may be formed in the opposed side walls of each tube element.

The body section of the animal is provided with a plurality of openings 36 in the opposed side walls, and each of such openings is arranged so as to be in alignment with the aperture in one of the tube elements. Thus, there is a corresponding opening in the sidewalk of the animal for each of the tube elements.

A pull pin 38 is slidably mounted in each of openings 36 and is dimensioned to slide within the corresponding aligned tube element aperture so as to extend across the through opening in the tube element. In this manner the pull pin prevents the passage of a pellet 40 through the tube element for dispensing through discharge opening 24. When the pull pin is retracted from the tube element the pellet is free to descend through the tube element onto the bottom wall of the cavity which directs the pellet through the discharge opening.

There is provided in the head section of the animal a downwardly directed passageway 42 which communicates at its upper end with pellet receiving opening 18 and at its other end with cavity 20 at a location therewithin above plate member 28. Passageway 42 may be formed as part of the head section of the animal or alternatively, a separate hollow tube member may be positioned within the head section. Included in the game apparatus are a plurality of pellets 40 which, in the preferred embodiments where the animal representation is that of a hen, goose or duck, takes the form of an egg. It will thus be seen that the pellet must be dimensioned such that it can sequentially into the pellet receiving opening 18, downwardly through passageway 42, through any one of the tube elements 32 (the one from which its pull pin has been retracted) and thence out of discharge opening 24.

The game apparatus also includes a selector element 46 which is preferably a spinner device that includes a base 48 and a spinner element 50 mounted rotatably on the base. The upper face 52 of the base is subdivided into a plurality of radial sectors 54. Desirably there are a greater number of such radial sectors than there are pull pins. However, there must be at least an equal number of such radial sectors. In the preferred embodiment of the invention each of the pull pins is given a different color and the radial sectors of the spinning device are color coded to match the pull pins. A nest 56 may be provided to receive the egg dispensed from discharge opening 24.

It will, of course, be appreciated that the pull pins may be provided in the form of brightly colored feathers to enhance the visual appearance of the game and, if desired, point values may be provided on the various pull pins.

The game is played by one player dropping a pellet into the mouth of the animal from whence it is directed downwardly onto the plate member. The duck is shaken and the pellet will migrate into one of the apertures and down into one of the tube elements. However, there is no way of ascertaining the particular tube element in which the pellet is lodged or the corresponding pull pins which can be retracted to clear the tube element and thereby permit the discharge of the pellet. The spinning device is manipulated by the player and the appropriate pull pin is retracted as dictated by the spinning device. If it is not the correct pull pin the next player manipulates the spinning device and retracts the pull pin dictated by alignment of the spinner pointer and the radial sector. Play thus continues until the correct pull pin is retracted and the pellet dispensed.

While a specific embodiment of a game apparatus has been disclosed in the foregoing description it will be understood that various modifications within the spirit of the invention may occur to those skilled in the art. Therefore, it is intended that no limitations be placed on the invention except as defined by the scope of the appended claims.

I claim:

1. Game apparatus comprising in combination:

a three dimensional animal representation including head and body sections and adapted to be self-supporting in an upright position;

a pellet receiving opening in said head section;

a cavity within said body section;

a plate member mounted horizontally within said cavity and having a plurality of apertures extending therethrough;

a downwardly inclined passageway in said head section communicating at the upper end thereof with said pellet receiving opening and at the lower end thereof with said cavity at a location above said plate;

a plurality of hollow tube elements each depending from a respective one of said plate apertures and having an aperture in at least the side wall thereof closest the adjacent internal surface of said body section;

a plurality of openings in the opposed side walls of said body section, each of said body section side wall openings being in alignment with the aperture in one of said tube elements;

a pull pin slidably mounted in each of said body section side wall openings and dimensioned to slide within the corresponding aligned tube element aperture, each of said pull pins having indicia adapted to visually distinguish same from the other of said pull pins;

a discharge opening in said body section adapted to receive the pellets descending from said tube elements and to discharge same from said body section;

at least one pellet dimensioned to pass sequentially through said pellet receiving opening, passageway, plate aperture, tube element and discharge opening;

and a selector element having indicia thereon representative of each of said pull pins.

2. Game apparatus according to claim 1, wherein said plate apertures are arranged in a pair of opposed rows.

3. Game apparatus according to claim 1, wherein said passageway communicating between the pellet receiving opening and the said cavity comprises a hollow tube member mounted in the head section.

4. Game apparatus according to claim 1, wherein said hollow tube elements are integral with said plate.

5. Game apparatus according to claim 1, wherein said pull pins are each given a different color and said selector element comprises a spinner device including rotatable spinner element and a base having an upper face which is subdivided into a plurality of radial sectors at least equal in number to the number of pull pins, there being a radial sector for each said pull pin color coded to match the respective pull pins.

6. Game apparatus according to claim 1, wherein said animal representation is that of a duck.

7. Game apparatus according to claim 1, wherein the lower extremity of said cavity is defined by a bottom wall element which inclines downwardly and terminates at said discharge opening.

* * * * *